US005206964A

United States Patent [19]

Wilson, Sr.

[11] Patent Number: 5,206,964

[45] Date of Patent: May 4, 1993

[54] BEACH BLANKET STABILIZER

[76] Inventor: Jerry D. Wilson, Sr., P.O. Box 963, Carrier Mills, Ill. 62917

[21] Appl. No.: 659,436

[22] Filed: Feb. 22, 1991

Related U.S. Application Data

[63] Continuation of Ser. No. 547,389, Jul. 3, 1990, abandoned.

[51] Int. Cl.[5] ..... A47G 9/00

[52] U.S. Cl. ..... 5/417; 5/420; 52/3

[58] Field of Search ..... 5/417–420, 5/448, 482, 474; 52/2.25, 3

[56] References Cited

U.S. PATENT DOCUMENTS

| | | | |
|---|---|---|---|
| D. 258,035 | 1/1981 | Fenwick | D6/267 |
| 1,577,586 | 3/1926 | Morehouse | 5/417 X |
| 1,624,797 | 4/1927 | Morehouse | 5/417 |
| 2,019,947 | 11/1935 | Allen | 24/72.5 |
| 2,507,091 | 5/1950 | Carlson | 24/72.5 |
| 2,589,476 | 3/1952 | Casey | 24/72.5 |
| 2,611,165 | 9/1952 | Straka | 24/72.5 |
| 2,809,006 | 10/1957 | Jansey | 248/361 |
| 2,907,057 | 10/1959 | Specht | 5/344 |
| 2,939,468 | 6/1960 | Boyce | 135/15 |
| 3,812,876 | 1/1975 | Graves | 52/3 X |
| 4,137,584 | 2/1979 | Sharber | 5/417 |
| 4,164,275 | 8/1979 | Davis | 190/2 |
| 4,546,507 | 10/1985 | Weinstein | 5/419 |
| 4,634,618 | 1/1987 | Greer et al. | 52/3 X |
| 4,709,430 | 12/1987 | Nicoll | 5/417 |

FOREIGN PATENT DOCUMENTS

| | | | |
|---|---|---|---|
| 1209228 | 2/1960 | France | 5/420 |
| 2400873 | 8/1977 | France . | |
| 2540366 | 2/1983 | France . | |
| 1264919 | 2/1972 | United Kingdom . | |

*Primary Examiner*—Michael F. Trettel
*Attorney, Agent, or Firm*—Heller & Kepler

[57] ABSTRACT

An inflatable stabilizer for use with a beach blanket or beach towel to prevent sand or dirt from getting on the blanket or towel, has an inflatable tube that is attached to the blanket or towel. The tube is a generally continuous tube and secured to the blanket or the towel provides a generally rigid peripheral edge that resists being buried in the sand or blown about on windy days.

20 Claims, 3 Drawing Sheets

BEACH BLANKET STABILIZER

This is a continuation of Ser. No. 07/547,309, filed on Jul. 3, 1990, now abandoned.

BACKGROUND OF THE INVENTION

The present invention relates in general to stabilizing blankets and towels and pertains, more particularly, to a stabilizer for a blanket or towel used at a beach or for other recreational purposes. The stabilizer of this invention is an improvement over conventional application of weights or relatively complicated hold down assemblies.

With the conventional beach blanket or towel for use at a beach, weight is applied to the corners or along the side of the towel in order to hold down the towel edges. The application of weight does not, however, prevent the towel from becoming covered by sand. Beach blankets and towels have a tendency to dig down in and around the center and edges as the people use and move around on them and the edges are covered with sand. The sand migrates to the center of the blanket or towel. The towel seems to collapse since it is not rigid. It will be understood from experience for most beachgoers that the blanket or towel is eventually covered with sand and must be lifted and shaken in order to remove the sand. The blanket or towel is then spread out again and weights again applied to the corners or other locations about the periphery. Other conventional stabilizing schemes require stakes or pegs for staking a blanket or towel hold down to the sand, presuming that the sand is not too loose for the stakes or pegs to obtain and maintain a purchase in the sand. These conventional schemes depend upon the user keeping track of and not loosing the stakes or pegs over time.

Observations at the beach and other recreational areas has shown that many people would rather avoid these problems by carrying light chairs and tables. The drawback of this avoidance of the problem is that carrying furniture is not convenient. Available parking is often far from the beach or recreation area and carrying furniture, even that which is small and lightweight, is a burden and much less convenient than an old fashioned beach blanket.

Accordingly, it is an object of the present invention to provide an improved stabilizer that is adapted to prevent the ends, sides, or corners of beach blankets or towels from becoming buried in the sand when the corners or edges of the blanket or towel is stepped upon. With the stabilizer of this invention it is believed that much time and effort will be saved by not having to constantly shake sand off towels and blankets while at the beach.

Another object of the present invention is to provide an improved stabilizer that is readily adaptable for use with a variety of sizes of towels or blankets.

A further object of the present invention is to provide an improved stabilizer that is easily carried to and from the beach and readily stored when not in use. The stabilizing member is inflatable and can be deflated to accomplish ease of transport and storage between uses.

Still another object of the present invention is to provide an improved stabilizer that is simple in design and manufacture and that can be manufactured from a number of materials for use as an assembled item or as a kit for application to existing towels or blankets.

Still a further object of the present invention is to provide a simple solution to the identified problem without requiring complicated or bulky assemblies having easy to lose members which are difficult or awkward to carry.

SUMMARY OF THE INVENTION

To accomplish the foregoing and other objects of this invention there is provided a beach blanket stabilizer for a blanket or towel typically used at a beach or for other recreational purposes. The stabilizer comprises means for providing an inflatable framework for the blanket or towel and means for attaching the framework to the blanket or towel. Valve means provides for inflation and deflation of the framework. The inflatable means is a generally tubular member that may be attached to and removed from the blanket or towel by a snap arrangement or a hook and loop arrangement. The inflatable member is preferably a continuous tube having a circular cross-section. The valve arrangement may be provided for either manual or pump inflation as desired. The shape of the inflatable member may be varied to match the shape of the edge of the blanket or towel.

These and other objects and features of the present invention will be better understood and appreciated from the following detailed description of one embodiment thereof, selected for purposes of illustration and shown in the accompanying drawing.

DETAILED DESCRIPTION

Figure 1:
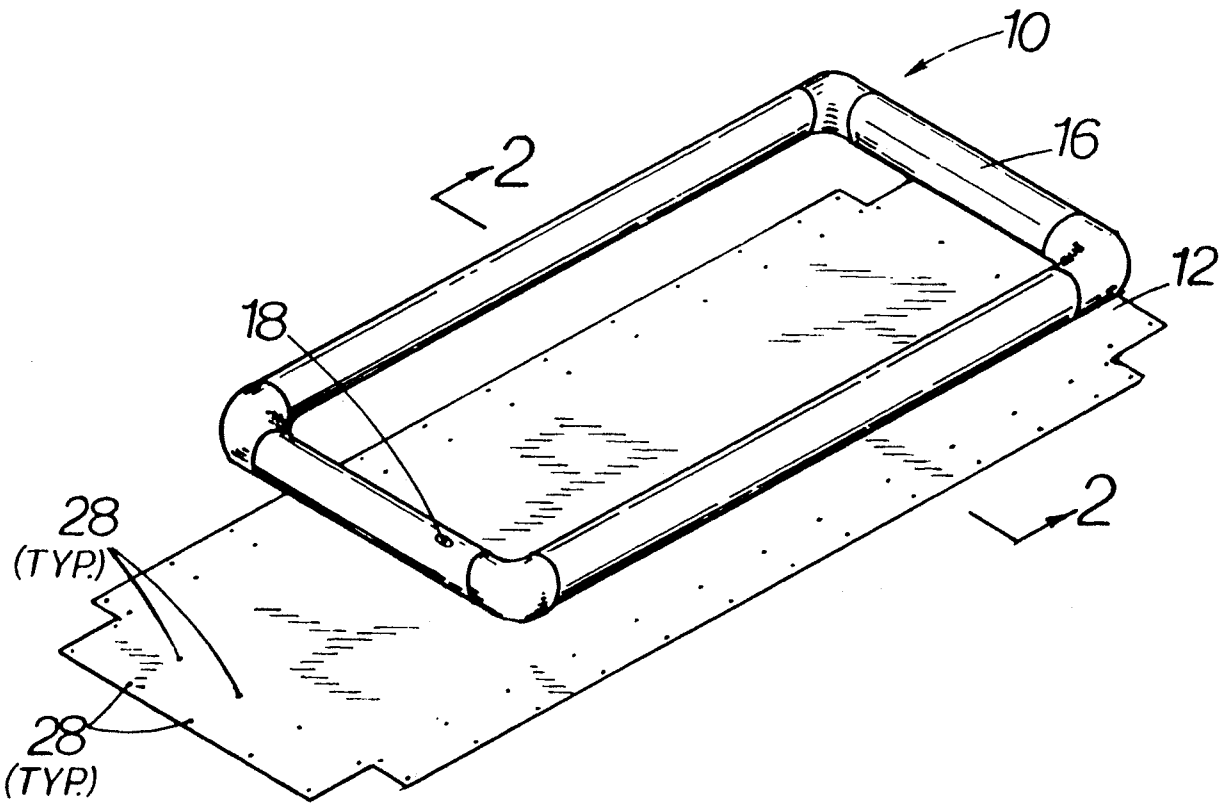
FIG. 1 is a schematic depiction of a blanket stabilizer constructed in accordance with the present invention.
Figure 2:
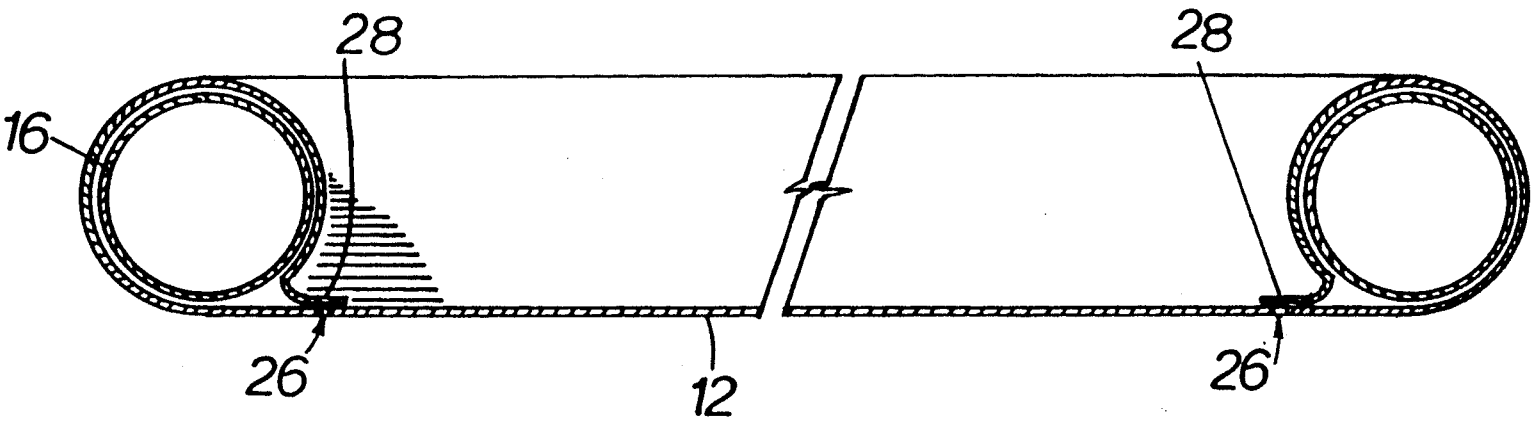
FIG. 2 is a cross-sectional view taken along line 2—2 in FIG. 1 after securing a blanket to an inflated stabilizer member.

Referring now to the drawings there is shown a preferred embodiment for the inflatable blanket or towel stabilizer of this invention. The inflatable stabilizer is described in connection with a beach blanket application for use on a sandy beach. The inflatable stabilizer of the present invention is particularly adapted for preventing ends, sides, or corners of beach blankets or towels from becoming buried in the sand when the corners or edges of the blanket or towel are stepped upon or blown by the wind.

The drawings show the inflated stabilizer frame assembly 10 in conjunction with a blanket 12. A towel or other similar member may be substituted for the blanket. It will be understood from the following description that the blanket or towel is not limited to the rectangular shape illustrated in FIG. 1. The blanket or towel may be square, circular, irregular, or include a hole for an umbrella.

An inflatable framework 14 is provided for stabilizing the blanket 12 in the sand of a beach. The framework 14 includes an inflatable tube 16. A valve member 18 provides means for inflation and deflation of the tube 16. The illustrated valve provides for manual inflation. Other valves may be provided for use with a conventional bicycle pump or a hand pump and needle combination. If a manual valve is provided, then it is of the type that recesses into the tube after inflation. This is a type of valve typically found on inflatable pool toys or flotation equipment.

The inflatable tube is preferably circular in cross-section is illustrated in the drawings. A preferred embodiment could be formed into a tube having a diameter of approximately four inches when inflated and formed with a seam oriented towards the bottom, that is, the same orientation as preferred for the valve 18.

Figure 3:
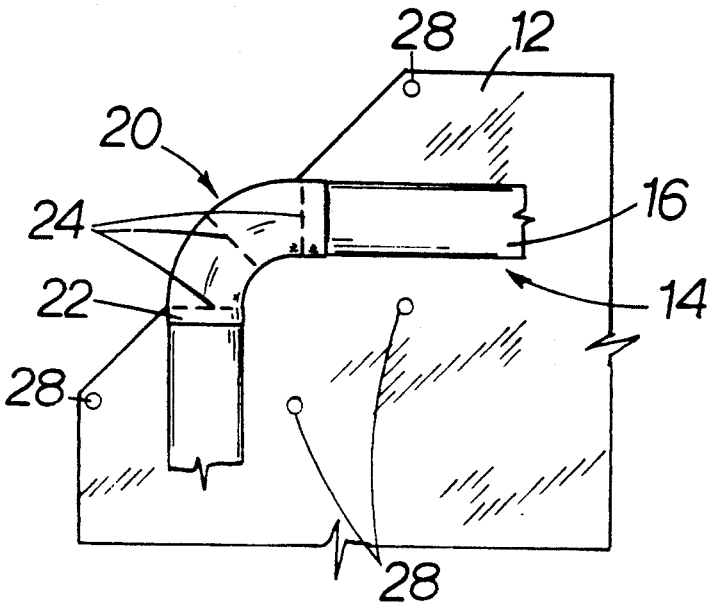
FIG. 3 is a partial plan view illustrating an embodiment of the present invention.
Figure 4:
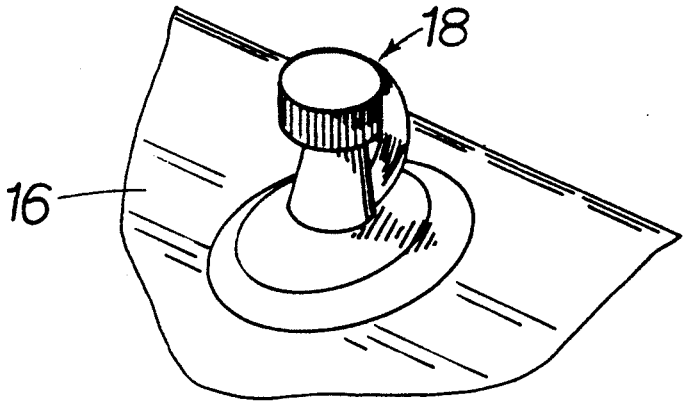
FIG. 4 is a schematic depiction of an air valve in accordance with a construction of the present invention.

A preferred embodiment for a corner assembly 20 is illustrated in FIG. 3. It is felt that the corners of the inflated tube 16 should be reinforced as indicated generally by reference character 22 in order to extend the life of the assembly. Further included in a preferred embodiment may be reinforcing and baffle member generally illustrated at 24. It is felt that the baffles will assist in reinforcing the corners while allowing air to circulate through the entire inflated tube. Alternatively, the corners may be reinforced and shaped with solid partitions and additional inflation valves will then be provided, at least one inflation valve for each partitioned sectioned. Thus, in the illustrated embodiment, if the reinforcing members were solid partitions, then at least four inflation valves would be provided. It will be understood that the baffles, partitions, or any other internal structure will be flexible, thereby allowing the deflated tube 16 to be folded or stored without interference from any rigid members, except for the inflation valve 18.

A blanket or towel attachment assembly 26 provides means for attaching the blanket, towel, or other generally flexible member to the inflatable tube 16. In a preferred embodiment the attachment may be accomplished with plastic or metal snaps or deformable plastic grommet and grommet inserts 28. The number of attachment members will depend upon the size of the blanket or towel and the material, for example, a light cotton material may require fewer attachment members than would a blended fabric of cotton, wool or synthetic, or a heavier muslin or wool material.

In operation, in connection with a beach blanket 12 previously mentioned to provide protection from the sand while at the beach, the inflatable tube 16 is inflated through inflation valve 18.

As shown in FIG. 3 each corner of the beach blanket 12 is formed with a notch that underlies the corner of the inflated tube and which allows each edge of the towel to be wrapped about the inflated tube independently of the other edges. Once inflated, the tube is secured to the blanket 12 by wrapping the blanket from underneath and around the top of the inflated tube and securing the snaps 28 or other fasteners as provided. The inflated framework and blanket assembly 10 is ready for use. The blanket is preferably used with the inflated tube 16 placed toward the sand. It will be understood that the tube may be placed on top. The tube on the bottom holds the blanket 12 above the sand. Used with the tube on the top, inflated tube 16 provides a dam against encroaching beach sand.

In a preferred embodiment the tube is four inches in diameter and the snaps 28 are placed approximately twelve inches apart except at the corner assemblies 20 as illustrated. The inflated tube 16 will preferably be a non-porous plastic or vinyl. Inflated devices are typically manufactured with at least one seam and is preferred that the seam, if any, be located on the bottom portion. The valve 18 will then be located away from the seam. The inflated member partially stiffens the blanket or towel making it difficult for the corners and edges to become buried in the sand.

While specific embodiments have been shown and described, many variations are possible. The particular shape of the inflatable tube and blanket or towel combination including all dimensions may be changed as desired to suit the application with which it is used. The materials may vary although vinyl and standard towel or blanket material is preferred. The configuration of the inflatable tube 16 and number of tube chambers, if more than one, may vary although the preferred embodiment is illustrated in the drawings. The fasteners could be provided in kit form to attach to existing blankets or towels or the blankets or towels will be provided with the fasteners already in place. It will be apparent that the stabilizer assembly of this invention may be used to down blankets or towels in other recreational settings, such as picnics or sunbathing.

Having described the invention in detail, those skilled in the art will appreciate that modifications may be made of the invention without departing from its spirit. Therefore, it is not intended that the scope of the invention be limited to the specific embodiment illustrated and described. Rather, it is intended that the scope of this invention be determined by the appended claims and their equivalents.

What is claimed is:

1. A stabilizer for use by a user in combination with a generally flexible member for providing a flexible member support, comprising:

inflatable framework means provided by a relatively flexible inflatable member, the inflatable member having a polygonal shape and being relatively flexible when uninflated;

a relatively flexible intermediate member having a polygonal shape with notches at the corners for providing a barrier intermediate an underlying surface and a user;

attaching means for attaching the inflatable framework means to the relatively flexible intermediate member and thereby stabilizing the combination of the inflatable framework and the relatively flexible member, the attaching means incorporating at least a portion of the intermediate member, the corners of the inflatable member overlying the notches of the flexible member, the flexible member detachably connected to the inflatable member by wrapping the intermediate member from underneath and around the top of the inflatable member, and the attaching means secures the inflatable member to the intermediate member; and valving means associated with the inflatable framework means, the valving means allowing the inflating of the inflatable framework means so as to hold a pressure within the inflatable framework means sufficient to maintain a stabilized, inflated framework means.

2. A stabilizer as set forth in claim 1 wherein inflatable framework means comprises an inflatable, generally tubular member.

3. A stabilizer as set forth in claim 2 wherein the generally tubular member is a continuous tube.

4. A stabilizer as set forth in claim 2 wherein the generally tubular member is substantially circular in cross-section.

5. A stabilizer as set forth in claim 1 wherein the attaching means comprises snap means associated with the flexible intermediate member, snap means located so as to allow the flexible member to be wrapped and fastened around inflatable framework means.

6. A stabilizer as set forth in claim 5 wherein flexible member and snap means comprise a beach blanket with a male snap member and a female snap member separated so as to allow the beach blanket to wrap around the flexible inflatable means and removably secure the beach blanket to the flexible inflatable means such that when inflated the flexible inflatable means forms a framework that at least partially stiffens the beach blanket.

7. A stabilizer as set forth in claim 5 wherein the flexible member and snap means comprise a beach towel with a male snap member and a female snap member separated so as to allow the beach towel to wrap around the flexible inflatable means and removably secure the beach towel to the flexible inflatable means such that when inflated the flexible inflatable means forms a framework that at least partially stiffens the beach towel.

8. A stabilizer as set forth in claim 1 wherein means for attaching the inflatable framework means to the relatively flexible intermediate member comprises a snap assembly including a male and a female portion.

9. A stabilizer as set forth in claim 1 wherein the attaching means for attaching framework means to the relatively flexible member comprises a hook and loop assembly including a hook portion attached to the flexible member and a loop portion attached to the flexible member so as to allow the flexible member to wrap around flexible inflatable means and secured thereto in a removable fashion.

10. An inflatable stabilizer for use in combination with a fabric or plastic generally flexible member for providing a support member in combination therewith, comprising:

an inflatable member having a polygonal shape;

a generally flexible member having a polygonal shape with notches at the corners and means for securing the generally flexible member about the inflatable member, the corners of the inflatable member overlying the notches of the flexible member, the flexible member incorporated for detachably connecting to the inflatable member the flexible member by wrapping the flexible member from underneath and around the top of the inflatable member, and the attaching means secures the inflatable member to the flexible member; and valve means for inflating and deflating the inflatable member.

11. An inflatable stabilizer as set forth in claim 10 wherein the inflatable member comprises an inflatable, continuous, generally tubular member.

12. An inflatable stabilizer as set forth in claim 11 wherein the inflatable member has a generally circular cross-section.

13. An inflatable stabilizer as set forth in claim 10 wherein the securing means comprise a two part snap arrangement with the parts spaced apart a distance sufficient to allow the flexible member to be attached around the inflatable member.

14. An inflatable stabilizer as set forth in claim 10 wherein the securing means comprise a hook and loop assembly including a hook portion attached to the flexible member and a loop portion attached to the flexible member to allow the flexible member to wrap around the inflatable member and be secured thereto in a removable fashion.

15. An inflatable stabilizer as set forth in claim 10 wherein the valve means comprise a valve for manual inflation of the inflatable member.

16. An inflatable stabilizer as set forth in claim 10 wherein the valve means comprise a valve suitable for inflation by a pump.

17. An inflatable stabilizer for providing a relatively rigid framework in combination with a beach blanket or a beach towel, comprising:

a continuous, generally polygonal tubular inflatable member;

a beach blanket or towel having a generally polygonal shape with notches at the corners and including at least one fastener for fastening the beach blanket or towel about the inflatable member, the corners of the inflatable member overlying the notches of the blanket or towel, the blanket or towel incorporated for detachably connecting the blanket or towel to the inflatable member by wrapping the blanket or towel from underneath and around the top of the inflatable member, and the attaching means secures the inflatable member to the blanket or towel; and an air valve for inflating and deflating the inflatable member.

18. An inflatable stabilizer as set forth in claim 17 wherein the inflatable member has a generally circular cross-section.

19. An inflatable stabilizer as set forth in claim 17 wherein the fastener comprises a two part snap arrangement with the parts spaced apart a distance sufficient to allow the beach blanket or towel to be attached to the inflatable member.

20. An inflatable stabilizer as set forth in claim 17 wherein the fastener comprises a hook and loop assembly including a hook portion and a loop portion attached to each other and to the blanket or towel so as to allow the blanket or towel to wrap around the inflatable member and be secured thereto in a removable fashion.

* * * * *